United States Patent [19]

Sugai

[11] Patent Number: 4,893,872

[45] Date of Patent: Jan. 16, 1990

[54] OFFICE CHAIR WITH WAIST SUPPORTER

[75] Inventor: Kiyoshi Sugai, Kawagoe, Japan

[73] Assignees: United Business Systems, Taiwan; Moriya & Co., Ltd., Tokyo, Japan

[21] Appl. No.: 169,327

[22] Filed: Mar. 17, 1988

[30] Foreign Application Priority Data

Jul. 18, 1987 [JP] Japan ..... 62-109584
Oct. 3, 1987 [TW] Taiwan ..... 76209618

[51] Int. Cl.[4] ..... A47C 7/02
[52] U.S. Cl. ..... 297/284; 297/460
[58] Field of Search ..... 297/284, 230, 460

[56] References Cited

U.S. PATENT DOCUMENTS 2,991,124 7/1961 Schwarz ..... 297/284
3,106,423 10/1963 Schwarz ..... 297/284
3,596,990 8/1971 Gottfried et al. ..... 297/284
4,097,087 6/1978 Garavaglia ..... 297/284
4,714,291 12/1987 Hattori et al. ..... 297/284
4,730,871 3/1988 Sheldon ..... 297/284

FOREIGN PATENT DOCUMENTS 1805997 6/1970 Fed. Rep. of Germany ..... 297/284
939909 10/1963 United Kingdom ..... 297/284

*Primary Examiner*—Francis K. Zugel
*Attorney, Agent, or Firm*—Baker & McKenzie

[57] ABSTRACT

An office chair having a waist supporter which is characterized in that a turning switch is installed on the back side of the chair's back-rest which is capable of adjusting said waist supporter by a user in the sitting position in order that the sitter who works for a long time in the office sitting in the chair can alleviate his fatigue by manually adjusting the waist supporter at his will.

2 Claims, 1 Drawing Sheet

Fig.1.
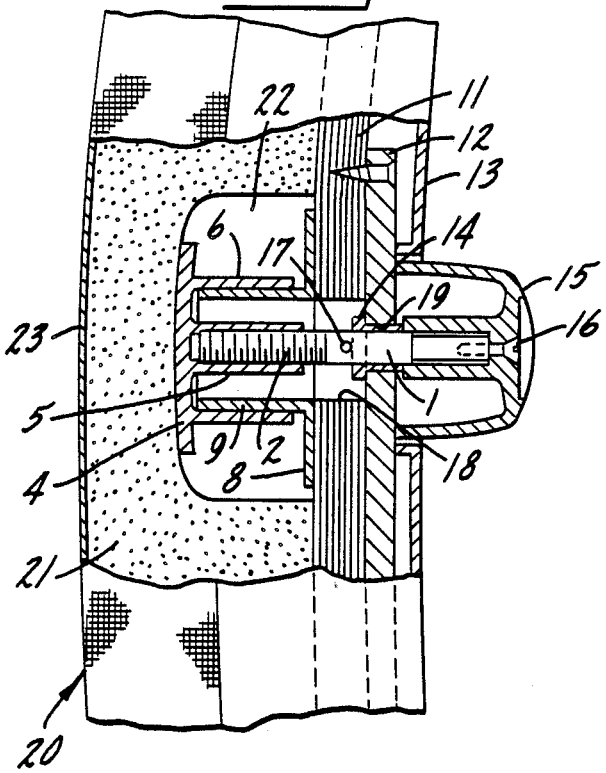
Fig.3.
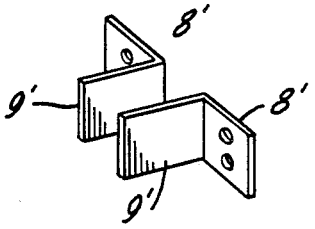
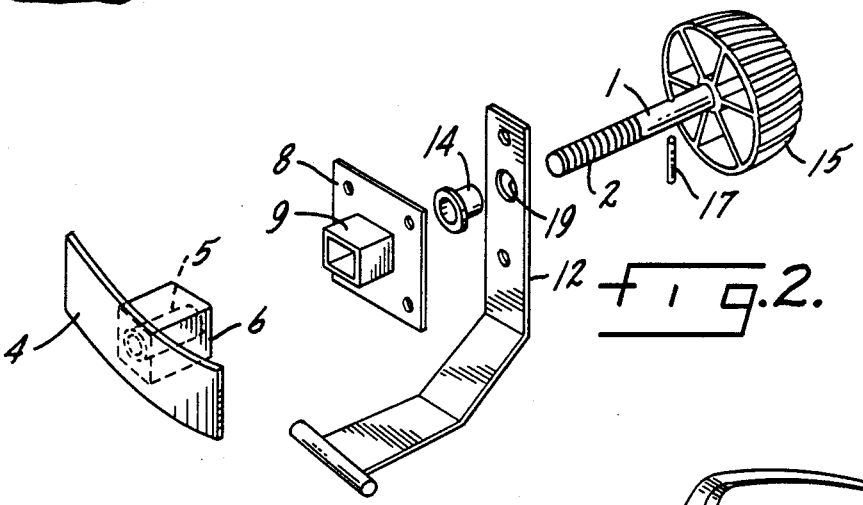
Fig.2.
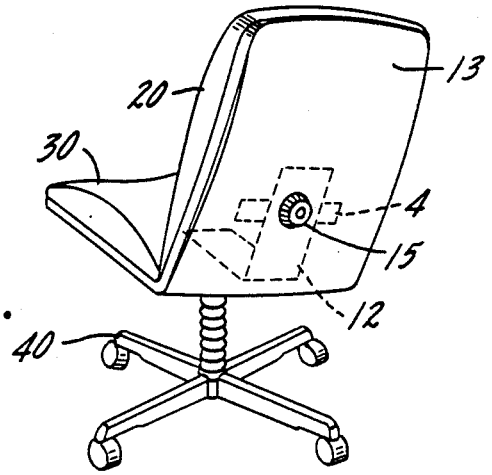
Fig.4.

OFFICE CHAIR WITH WAIST SUPPORTER

TECHNICAL FIELD

The present invention relates generally to an office chair equipped with a waist supporter. In particular, it relates to an office chair having a simply constructed adjusting mechanism in which a turning switch or knob for adjusting the waist supporter is installed on the back of the chair's back-rest to enable the sitter to easily operate the waist supporter manually.

BACKGROUND OF THE INVENTION

Conventionally, for improving the buffer hardness for the sitter's waist and spinal column, the back-rest of the chair on board an aircraft or bus has been installed with an adjustable waist supporter to lessen the fatigue. An example is disclosed in Japanese Laid Open Pat. No. 57-826.

Although office chairs also have the need of being equipped with an adjustable waist supporter, it is very difficult in act to apply the same adjusting mechanism as used on board an aircraft or bus to the office chair, owing to the former being operated by a mechanism installed on the chair's side to made the back-rest move forward or backward using a complex lever and gear construction.

SUMMARY OF THE INVENTION

Generally, the back-rest of an office chair needs only a width fitting the back of a human body. Accordingly, one can easily extend one's hand to the relative position of the waist on the back of the chair's back-rest when sitting down.

In the present invention, based on this human physical condition, a turning switch for adjusting the waist supporter is installed on the back of the chair's back-rest to enable the sitter to easily and practically operate the adjusting switch. That is, the present invention comprises an adjusting mechanism for a waist supporter in which a turning shaft with a front screw thread is installed through the back-rest frame of the chair, a screw nut which receives the front screw thread portion of the turning shaft is carried on a supporting board at the back portion of the back-rest frame at the approximate level of the waist's spinal column, a connecting part is received in a non-cylindrical sleeve and (for an example, a rectangle) control part is fixed to the front of the frame, and a turning switch is fixed to the end of the turning shaft which enables the supporting board for the spinal column to contact the concave bottom of the buffer material at the chair's back-rest.

Generally, the office chair is equipped at its foot strut with an upward and downward adjustable and turnable platform, and the supporting frame connecting the seat and back-rest can be leaned forward or backward. A base board is fixed to the chair's back-rest at the supporting frame, and a buffer material, such as foamed plastics, is laminated on the surface. Thereafter, the circumference is covered with an outer leather material.

The spinal supporting board should be located at the lower part of the third section of the sitter's back spinal column and contacted by the buffer material within 15–20 cm above the chair seat, and is movable forward and backward by means of the adjustable mechanism of the waist supporter.

The movement of the waist supporting board is determined by the rotation of the turning shaft (which is installed through the chair's back board and is connected to the chair seat's supporting frame) relative to the screw nut mounted on the waist supporting board. By means of the rectangular cylinder surrounding the screw nut and perpendicularly carried by the waist supporting board and the complementary construction of the control part fixed to the frame's front which is received therein, the supporting board for the user's spine can be moved smoothly along the shaft to its desired position and, at the same time, movement of the supporting board around the turning shaft can be precluded, with the result that the waist supporting board is supported securely.

The convex part fixed to the frame and the insert received in the rectangular cylinder, which is mounted to the waist's supporting board, may be integrated as a whole for use as a control part. However, the angle bar or connecting insert which is received in the inside of the rectangular cylinder may also be fixed to the frame by two simple angles.

In the present invention, the office chair with a waist supporter is designed to enable the sitter to extend his hand in a sitting position to the back of the chair's back-rest to turn the switch or adjustment knob so that the supporting board for the waist spinal column can be moved smoothly and safely through the action of the connection between the rectangular cylinder and the control part. At the same time, the hardness of the surface of buffer material of the chair's back-rest which contacts the waist's spinal column may be easily adjusted into the most suitable position.

An embodiment of the present invention is herewith illustrated by the attached drawings and following detailed description.

BRIEF DESCRIPTION OF THE DRAWINGS

FIG. 1 is a partial section view, with parts broken away for clarity, of the main portion of the waist supporter of an office chair back-rest;

FIG. 2 is an exploded perspective view showing the separate parts of the adjusting mechanism of the waist supporter;

FIG. 3 is a perspective view of an improved control part; and

FIG. 4 is a perspective view of an office chair which is equipped with a waist supporter of this invention.

DETAILED DESCRIPTION

In the drawings, 1 is the turning shaft which has a front screw part 2 at its front end. 4 is a supporting board for the waist's spinal column, and usually is a 50 mm in length by 160 mm in width, slightly bent, rectangular board made of metal or synthetic resin. 5 is a screw nut cylinder installed perpendicularly to the inner center of the waist supporting board 4. 6 is a rectangular cylinder which envelops the screw nut cylinder 5 in such a way that its upper and lower surfaces are parallel with the longer sides of the waist supporting board 4. It is installed perpendicularly to the rectangular cylinder of the waist supporting board 4 and has a 30 mm length. 8 is the control part from the surface of which the cylindrical connecting portion 9 projects in a position to be received in the aforesaid rectangular cylinder 6. The length of the cylinder of the connecting portion 9 is about 28 mm, and therefore its stroke can be adjusted up to a maximum of about 25 mm. 12 is a supporting frame which connects the fixed seat 30 with the chair's back-rest 20 (see FIG. 4).

The chair's back-rest 20 is fixed to the base frame 11 which in turn is carried by the supporting frame 12. The front part and the circumference of the base board frame 11 are laminated with foamed buffer material 21 and then covered with leather 23, and its rear is covered with the external board 13. At the waist spinal column's contact position, a concave portion 22 is formed within the buffer material 21. An opening 18 with a large inner diameter is located in the base board frame 11. A hole 19 in supporting frame 12 receives the shaft bearing's casing 14 which supports the turning shaft 1.

Prior to lamination of the above mentioned buffer material 21 with base board frame 11, the flange of the control part 8 is fixed to the front of the edge of the base board frame 11 about the opening 18. Pin 17 which is used for preventing escape of turning shaft 1 is inserted from opening 18 just ahead of the shaft bearing's casing 14, whereby the rear part of shaft protrudes out to the external board 13 of the back of the chair's back-rest 20. Screwing switch 15 is screwed onto turning shaft 1 to fix the position of the shaft with respect to the base board frame 11. The screwing switch is fixed to turning shaft by a small threaded reverse screw 16. The rectangular cylinder 9 of control part 8 is put into the rectangular cylinder 6, and then the switch 15 is operated to bring the waist's supporting board 4 nearly into contact with the front of the base frame 11.

As stated above, the control part 8 and waist supporting board 4 are first located in the concave region 22 within the buffer material 21, and then the buffer material 21 is adhered to the base frame 11 and thereafter covered with an outer clothing material 23. Thereafter the outer covering board 13 on the back is screwed tightly to install the adjusting mechanism of the waist supporter to the chair's back-rest 20.

FIG. 3 is a perspective view of an improved control part in which the control part 8 and cylindrical connecting member 9 of FIG. 2 are replaced by two simple L-shaped angles bars each of which has an angle section 8' which is secured to the base frame 11 and similar angle sections 9', 9' which are received in rectangular cylinder 6.

As mentioned above, the adjusting mechanism of the office chair waist supporter of the present invention is a simple structure and which occupies a small volume and which can easily adjust the waist supporter by a user from the sitting position. The invention particularly contributes to the alleviation of fatigue of those who have to sit in an office working for a long time.

Although two specific embodiments of the invention have been illustrated and described, it will at once be apparent that modifications may be made within the scope of the invention by those skilled in the art. Accordingly, the scope of the invention is not intended to be limited by the foregoing description, but, rather by the hereinafter appended claims when interpreted in light of the relevant prior art.

What is claimed is

1. A waist supporter for an office chair having a back board frame (11) covered, on the user's side, with buffer material (21), said waist supporter including, in combination, a generally planar waist support member (4) disposed within a cavity (22) in the buffer material (21), and means for moving the waist support member toward and away from the back board frame (11), said means comprising locating structure (8, 9, 8',8', 9'9') fixed to back board frame (11) and projecting toward the waist support member (4), guide means (6) carried by the waist support member (4) and projecting toward the back board frame (11), said locating structure being non-rotatably and telescopically coupled with the guide means for adjusting movement toward and away from the waist support member, adjustment means (15, 1, 16, 17, 2, 5) for moving the locating structure toward and away from the guide means, said adjustment means including screw means (1, 19, 14, 17, 12, 15, 16) which are rotatable, but not reciprocable, with respect to the back board frame, and connector means (2, 5) which cooperate to permit the guide means, and thus the waist support member, to move toward and away from the back board frame.

2. In an office chair having a frame including a back rest having buffer material (21) and a waist supporter, said waist supporter comprising: a turning shaft (1) equipped with a front screw part (2), said screw part being installed through the backrest (2); a screw nut (5) engagable with a screw part (2), and a non-circular cylinder (6) surrounding said screw nut, said cylinder being perpendicularly installed to a planar waist supporting member (4); a control part (8) formed with a connecting part (9) perpendicularly installed to the front of the frame 11 and telescopically engaged with the cylinder (6); and a waist supporter adjusting mechanism formed by a turning switch (15) which is fixed to an outer end of the turning shaft (1) and which makes the waist supporting member contact the buffer material.

* * * * *